US009305695B2

(12) United States Patent
Karasek et al.

(10) Patent No.: US 9,305,695 B2
(45) Date of Patent: Apr. 5, 2016

(54) CURRENT-COMPENSATED CHOKE AND CIRCUIT ARRANGEMENT WITH A CURRENT-COMPENSATED CHOKE

(75) Inventors: Manfred Karasek, Steinheim (DE); Markus Straub, Steinheim (DE)

(73) Assignee: EPCOS AG, Munich (DE)

( * ) Notice: Subject to any disclaimer, the term of this patent is extended or adjusted under 35 U.S.C. 154(b) by 13 days.

(21) Appl. No.: 12/697,538

(22) Filed: Feb. 1, 2010

(65) Prior Publication Data

US 2010/0194517 A1 Aug. 5, 2010

Related U.S. Application Data

(63) Continuation of application No. PCT/EP2008/058209, filed on Jun. 26, 2008.

(30) Foreign Application Priority Data

Aug. 1, 2007 (DE) ..... 10 2007 036 052

(51) Int. Cl.

| | |
|---|---|
| ***H01F 27/02*** | (2006.01) |
| ***H01F 19/08*** | (2006.01) |
| ***H01F 5/00*** | (2006.01) |
| ***H01F 17/04*** | (2006.01) |
| *H01F 27/34* | (2006.01) |
| *H01F 27/38* | (2006.01) |
| *H01F 37/00* | (2006.01) |

(52) U.S. Cl.

CPC ..... *H01F 19/08* (2013.01); *H01F 5/00* (2013.01); *H01F 17/045* (2013.01); *H01F 27/02* (2013.01); *H01F 27/346* (2013.01); *H01F 27/385* (2013.01); *H01F 37/00* (2013.01)

(58) Field of Classification Search

CPC ..... H01F 5/00; H01F 27/00–27/36
USPC ..... 336/65, 83, 192, 200, 220–223, 232
See application file for complete search history.

(56) References Cited

U.S. PATENT DOCUMENTS

| | | | | |
|---|---|---|---|---|
| 2,535,554 | A | 12/1950 | Thurston | |
| 5,521,573 | A | 5/1996 | Inoh et al. | |
| 5,719,547 | A * | 2/1998 | Kaneko et al. | 336/180 |
| 5,831,505 | A | 11/1998 | Yamaguchi et al. | |
| 6,373,366 | B1 * | 4/2002 | Sato et al. | 336/192 |
| 6,392,523 | B1 * | 5/2002 | Tsunemi | 336/192 |
| 6,965,289 | B2 * | 11/2005 | Toi et al. | 336/83 |

(Continued)

FOREIGN PATENT DOCUMENTS

| | | |
|---|---|---|
| CH | 322776 | 6/1957 |
| CN | 1177191 A | 3/1998 |

(Continued)

OTHER PUBLICATIONS

FlexRay Electrical Physical Layer Application Notes, Chapter 2: Application Notes, 2.4 Application hint: Common mode chokes, Nov. 2006, p. 11 of 39.

*Primary Examiner* — Tuyen Nguyen
(74) *Attorney, Agent, or Firm* — Slater & Matsil, L.L.P.

(57) ABSTRACT

A current-compensated choke features several current paths and includes several windings that are connected in parallel and wound around a common core. The windings preferably are alternately wound on the core in such a way that windings of a common current path are not arranged directly one on top of another.

16 Claims, 2 Drawing Sheets

(56) References Cited

U.S. PATENT DOCUMENTS

| | | | | |
|---|---|---|---|---|
| 7,319,923 | B2 | 1/2008 | Hoenninger et al. | |
| 7,362,205 | B2 | 4/2008 | Ito et al. | |
| 7,791,444 | B2 * | 9/2010 | Tomonari et al. | 336/192 |
| 7,855,627 | B2 * | 12/2010 | Nishikawa et al. | 336/200 |
| 7,889,045 | B2 * | 2/2011 | Tomonari et al. | 336/200 |
| 2003/0030526 | A1 | 2/2003 | Hirai et al. | |
| 2005/0145408 | A1 * | 7/2005 | Hess | 174/52.1 |
| 2005/0174816 | A1 * | 8/2005 | Nishikawa et al. | 363/83 |
| 2005/0237141 | A1 * | 10/2005 | Hirai et al. | 336/83 |
| 2007/0285200 | A1 * | 12/2007 | Hsieh | 336/83 |
| 2008/0309445 | A1 * | 12/2008 | Suzuki et al. | 336/183 |
| 2010/0199012 | A1 | 8/2010 | Hugel | |

FOREIGN PATENT DOCUMENTS

| | | | |
|---|---|---|---|
| DE | 876 718 | | 5/1953 |
| DE | 1 538 144 | | 8/1969 |
| DE | 1 802 830 | | 5/1970 |
| DE | 26 00 765 | A1 | 7/1977 |
| JP | 60-090921 | U | 6/1985 |
| JP | 01-304711 | A | 12/1989 |
| JP | 03-030419 | U | 3/1991 |
| JP | 2000114052 | A * | 4/2000 |
| JP | 2001-189225 | A | 7/2001 |
| JP | 2002-043144 | A | 2/2002 |
| JP | 2002-246244 | A | 8/2002 |
| JP | 2003-124031 | A | 4/2003 |
| JP | 2003100531 | A * | 4/2003 |
| JP | 2003-234218 | A | 8/2003 |
| JP | 2004-158599 | A | 6/2004 |
| JP | 2004273490 | A * | 9/2004 |
| JP | 2005039446 | A * | 2/2005 |
| JP | 2005-096758 | A | 4/2005 |
| JP | 2005-244351 | A | 9/2005 |
| JP | 2006-339250 | A | 12/2006 |
| JP | 2007-089133 | A | 4/2007 |
| JP | 2010-500838 | A | 1/2010 |
| WO | WO 2006/039662 | A2 | 4/2006 |

* cited by examiner

CURRENT-COMPENSATED CHOKE AND CIRCUIT ARRANGEMENT WITH A CURRENT-COMPENSATED CHOKE

This application is a continuation of co-pending International Application No. PCT/EP2008/058209, filed Jun. 26, 2008, which designated the United States and was not published in English, and which claims priority to German Application No. 10 2007 036 052.7 filed Aug. 1, 2007, both of which applications are incorporated herein by reference.

TECHNICAL FIELD

Embodiments of the invention relate to a current-compensated choke and a circuit arrangement with a current-compensated choke.

BACKGROUND

A current-compensated choke is known from German patent publication DE 26 00 765 A1.

SUMMARY

In one embodiment, a current-compensated choke has at least two windings that are arranged on a common core and through which current flows in such a way that their magnetic fields cancel each other out. For example, embodiments of the invention disclose a choke, in which a, insofar as possible, complete cancellation of magnetic fields and a, insofar as possible, lowest resistance are achieved.

A current-compensated choke includes several current paths, wherein each of these current paths features several windings that are connected in parallel. The windings are wound on a common core. The current paths are preferably configured for opposite current directions. The choke can also be used if the current paths have equidirectional current paths. The windings are preferably realized such that the magnetic fields generated by the current paths cancel one another out.

Due to the parallel connection of several windings into a common current path, it is possible to achieve low resistance values as they are required for certain applications such as, for example, in databus systems.

It is preferred that each of the individual windings forms a complete layer around the core, wherein the layer covers the core, insofar as possible, completely in the longitudinal direction.

According to one embodiment, the individual layers of the windings therefore form an arrangement of several layers that are arranged around the core.

The windings belonging to different current paths are preferably arranged on the core alternately one on top of another.

Windings belonging to a common current path are preferably not arranged on the core directly one on top of another. For example, a first winding of a second current path is situated on top of a first winding of a first current path and followed by the second winding of the first current path that, in turn, is followed by the second winding of the second current path. This arrangement approximately corresponds to a double winding arrangement that facilitates a nearly complete cancellation of the magnetic fields of the windings belonging to the current paths. This makes it possible to achieve a reduced leakage inductance of the choke, as well as an improved quality of the choke.

If there are more than two current paths, the windings are arranged such that windings belonging to the same current path are preferably not wound on the core directly on top of or underneath one another.

The core preferably comprises a rod-shaped core. According to one embodiment, this core contains ferromagnetic material.

The windings on the core are preferably arranged such that the magnetic fields generated by the current paths at least for the most part compensate one another. If the current paths have opposite directions, all windings preferably have the same winding direction. This cancels out the magnetic fields generated by the current flowing in the opposite direction. If the current paths have the same direction, the windings belonging to each of the current paths have a different winding direction. The arrangement of the windings belonging to the current paths is preferably realized such that the magnetic fields generated by the current paths cancel one another out.

In one embodiment, the windings on the core are for the most part surrounded by a cap. This results in an additional reduction of the leakage inductance.

In another embodiment, a cover plate that lies on the windings may be provided instead of the cap.

A cap or a plate causes an improved magnetic closing of the field lines. The leakage inductance is reduced due to the improved magnetic closing. Furthermore, the improved closing makes it possible to reduce the number of windings of the same inductor such that the ohmic resistance can also be reduced. Although a small air gap is formed when a cap or a cover plate is used, here the configuration more closely resembles an ideal toroidal core choke.

The choke preferably features several external contacts, wherein two external contacts are respectively provided for each current path in order to contact the choke, and wherein the current paths are electrically conductively connected to the external contacts.

Due to the special arrangement of the windings belonging to the current paths, an approximately identical resistance of the current paths is achieved due to the length ratio of the individual windings. Consequently, a minimal leakage inductance is achieved during the mutual cancellation of magnetic fields due to the alternately arranged windings.

The current-compensated choke is preferably used in a circuit arrangement in which the current-compensated choke is inserted into the data lines of a databus. The first data path of the choke is connected in series with a first conductor of the data line and the second current path of the choke is connected in series with a second conductor of the data line. In the current-compensated choke, the ends of a first current path of the choke are connected to a first conductor of a data line, and the ends of a second current path are connected to a second conductor of a data line. The electric conductors of the data line are exposed to an electromagnetic noise source such that the current flowing through the electric conductors of the data line does not have the same current intensity in different directions.

The choke is preferably connected to data lines or to a bus system in the circuit arrangement. The data lines may form part of a control and communication network in a motor vehicle. These preferably comprise CAN bus systems or FlexRay bus systems, in which the circuit arrangement can be used.

In addition, the choke is also suitable for data transmission in bus systems, on which strict limits with respect to the leakage inductance and the DC resistance are imposed.

The described subject matter is explained below with reference to the following figures and exemplary embodiments.

BRIEF DESCRIPTION OF THE DRAWINGS

The drawings described below are not true to scale. On the contrary, individual dimensions may be illustrated in an enlarged, reduced or even distorted fashion in order to improve the illustration.

Elements with similar or identical functions are identified by the same reference symbols.

The following list of reference symbols can be used in conjunction with the drawings:

1, 2 Current path

1*a*, 1*b*, 2*a*, 2*b* Winding

3 Core

4 Cap

6*a*, 6*b*, 6*c*, 6*d* External contacts

DETAILED DESCRIPTION OF ILLUSTRATIVE EMBODIMENTS

Figure 1:
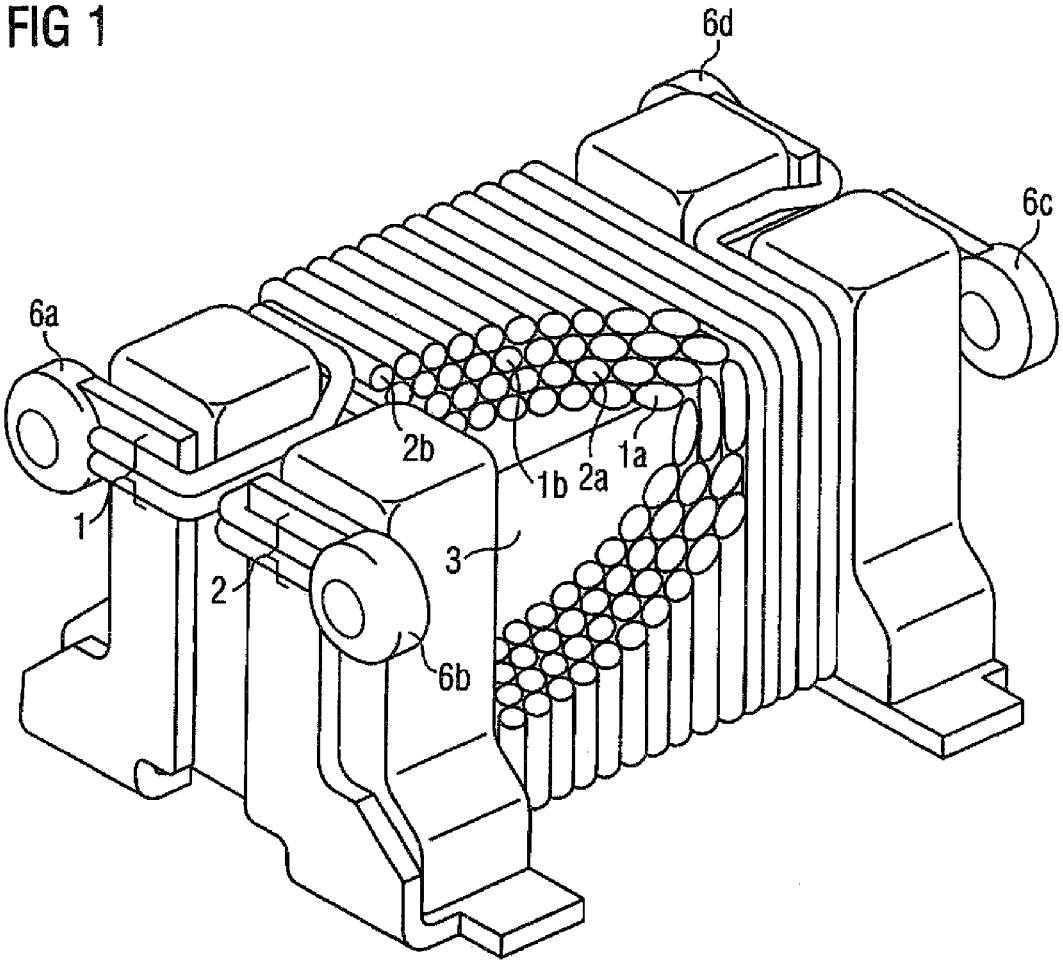
FIG. 1 shows a first embodiment of the current-compensated choke.

FIG. 1 shows a current-compensated choke, in which several windings 1*a*, 1*b*, 2*a*, 2*b* are wound around a common core 3. The core 3 is preferably rod-shaped and features ferromagnetic material.

On its two end faces, the choke features several external contacts 6*a*, 6*b*, 6*c*, 6*d*, on which two of the windings 1*a*, 1*b*, 2*a*, 2*b* that are connected in parallel into a common current path 1, 2 are respectively electrically contacted.

The windings 1*a*, 1*b*, 2*a*, 2*b* are preferably wound on the core 3 alternately such that windings 1*a*, 1*b*, 2*a*, 2*b* that lie directly one on top of another do not belong to one and the same current path 1, 2.

Consequently, this results in a sequence that begins with a first winding 1*a* of a first current path 1. This winding is followed by a first winding 2*a* of a second current path 2 that, in turn, is followed by the second winding 1*b* of the first current path 1. The final winding is formed by the second winding 2*b* of the second current path 2.

According to one embodiment, the individual layers of the windings 1*a*, 1*b*, 2*a*, 2*b* are arranged laterally offset relative to one another. In this case, each winding 1*a*, 1*b*, 2*a*, 2*b* of each layer could lie in the intermediate space between two windings 1*a*, 1*b*, 2*a*, 2*b* of an adjacent layer and at least partially fill this intermediate space. Thus, a space-saving configuration is proposed, in which the leakage inductances can be reduced.

If there are more than two current paths 1, 2, the windings 1*a*, 1*b*, 2*a*, 2*b* are arranged such that windings 1*a*, 1*b*, 2*a*, 2*b* to be assigned to a common current path 1, 2 preferably do not lie directly one on top of another.

Figure 2:
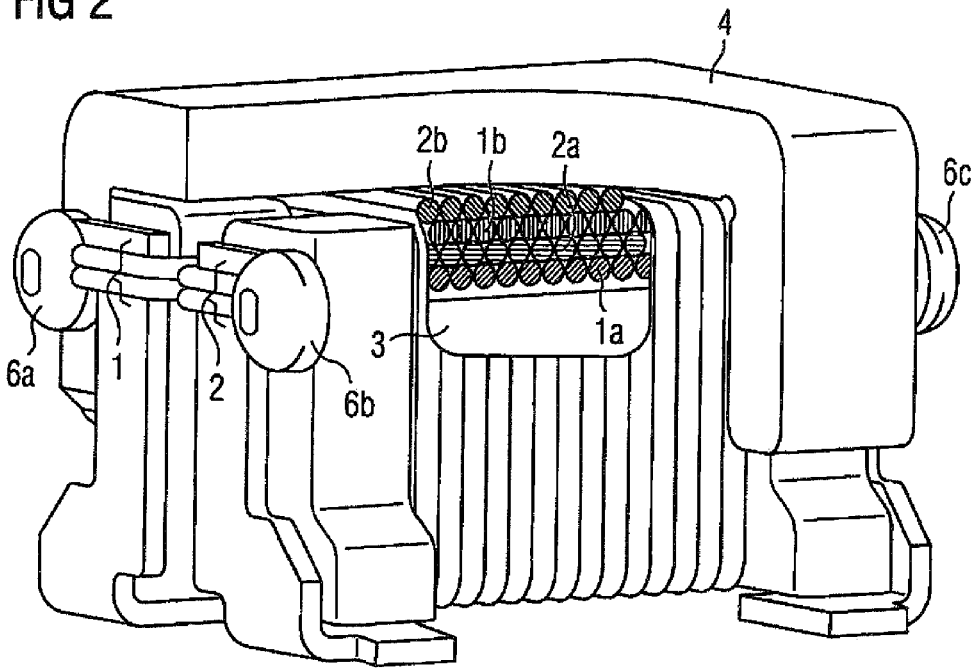
FIG. 2 shows another embodiment of the current-compensated choke with attached cap.

FIG. 2 shows one possible embodiment of the choke with a cap 4 that at least for the most part surrounds the wound core 3. In a not-shown alternative embodiment, a cover plate may be provided on the wound core instead of the cap 4.

Figure 3:
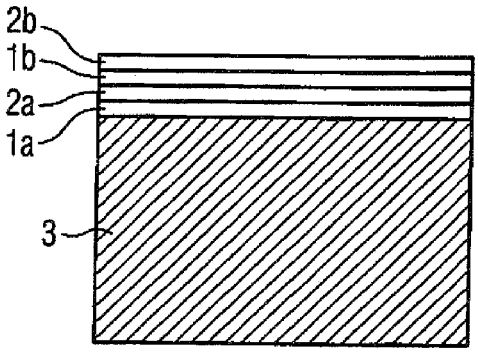
FIG. 3 shows a schematic representation of the windings around the core of the current-compensated choke.

FIG. 3 shows a schematic representation of the windings 1*a*, 1*b*, 2*a*, 2*b* around the core 3. In this case, the windings 1*a*, 1*b*, 2*a*, 2*b* are illustrated in the form of layers. This is intended to elucidate the sequence of the windings 1*a*, 1*b*, 2*a*, 2*b*.

This schematic representation shows how the windings 1*a*, 1*b*, 2*a*, 2*b* of the current paths 1, 2 mutually alternate. No windings 1*a*, 1*b*, 2*a*, 2*b* that belong to a common current path 1, 2 lie directly one on top of another.

In another not-shown exemplary embodiment, the principle of the current-compensated choke is elucidated with the aid of exemplary values. An available choke with a winding chamber of 2 mm and a required nominal inductance of 100 μH requires 40 windings. Based on the size of the winding chamber and the number of windings, the maximum wire diameter to be used is 50 μm. This would result in a resistance of 2 Ω/current path. However, a resistance of only 1 Ω/current path is required. The parallel connection of two current paths makes it possible to achieve the lowest possible resistance value.

The above-described arrangement of the individual windings makes it possible to achieve a leakage inductance that meets the required specifications, for example, for bus systems in motor vehicles. In this case, only the leakage inductance is optimized. In order to achieve an optimization with respect to the smallest possible difference between the resistances of the two current paths, the most suitable configuration would be a combination of the first winding with the fourth winding and a combination of the second winding with the third winding, but in this case the effect of a low leakage inductance would be lost.

It would be possible, in principle, to choose a different core shape, to use several current paths or to connect more than two windings in parallel, for example, in order to achieve lower resistance values.

What is claimed is:

1. A current-compensated choke with two current paths, wherein each current path comprises a plurality of windings that are connected in parallel and wound on a common core, wherein each winding forms an individual layer around the core such that each individual layer includes only one winding, wherein the individual layers lie one on top of another and are at least partially laterally offset from one another, and wherein the windings belonging to the two current paths are alternately arranged one on top of another; and wherein the windings are arranged in such a way that magnetic fields generated by the current paths at least for the most part compensate one another, wherein all windings have the same winding direction, which allows cancellation of magnetic fields caused by current paths having opposite directions;

wherein the current-compensated choke further comprises a cap, wherein the windings are substantially surrounded by the cap and wherein the cap serves as part of the core.

2. The current-compensated choke according to claim 1, wherein the core comprises a ferromagnetic material.

3. The current-compensated choke according to claim 1, wherein the core has the shape of a rod.

4. The current-compensated choke according to claim 1, further comprising a cover plate, wherein the core surrounded by the current paths is provided with the cover plate.

5. The current-compensated choke according to claim 1, further comprising a plurality of external contacts, wherein the current paths are each connected to two external contacts.

6. The current-compensated choke according to claim 1, wherein the current paths have a substantially identical resistance.

7. The current-compensated choke according to claim 6, wherein the current paths have a substantially identical resistance based on a length ratio of the individual windings.

8. A current-compensated choke with a first current path and a second current path, wherein each current path comprises a first winding and a second winding that are connected in parallel and wound on a common core;

wherein each winding forms an individual layer around the core and each individual layer includes only one winding, wherein a wire from a first individual layer lies at least partially within an intermediate space between two wires of a second individual layer adjacent to the first individual layer;

wherein the individual layers lie on top of another in such a manner that the first winding of the first current path is followed by the first winding of the second current path, the first winding of the second current path is followed by the second winding of the first current path, and the second winding of the first current path is followed by the second winding of the second current path, wherein the windings are arranged in such a way that magnetic fields generated by the current paths at least for the most part compensate one another, wherein the windings belonging to each of the current paths have opposite winding direction, which allows cancellation of magnetic fields caused by current paths having the same direction;

wherein the first winding of the second current path has a greater distance from the core than the first winding of the first current path, the second winding of the first current path has a greater distance from the core than the first winding of the second current path, and the second winding of the second current path has a greater distance from the core than the second winding of the first current path; and wherein the current-compensated choke further comprises a cap, wherein the windings are substantially surrounded by the cap.

9. The current-compensated choke according to claim 8, wherein the core comprises a ferromagnetic material.

10. The current-compensated choke according to claim 8, wherein the core has the shape of a rod.

11. The current-compensated choke according to claim 8, further comprising a cover plate, wherein the core surrounded by the current paths is provided with the cover plate.

12. The current-compensated choke according to claim 8, further comprising a plurality of external contacts, wherein the current paths are each connected to two external contacts.

13. The current-compensated choke according to claim 8, wherein the current paths have a substantially identical resistance.

14. The current-compensated choke according to claim 13, wherein the current paths have a substantially identical resistance based on a length ratio of the individual windings.

15. A current-compensated choke with two current paths, wherein each current path comprises a plurality of windings that are connected in parallel and wound on a common core, wherein each winding forms an individual layer around the core such that each individual layer includes only one winding, wherein the individual layers lie at least partially laterally offset and one on top of another, and wherein the windings belonging to the two current paths are alternately arranged one on top of another; and wherein the windings are arranged in such a way that magnetic fields generated by the current paths at least for the most part compensate one another, wherein all windings have the same winding direction, which allows cancellation of magnetic fields caused by current paths having opposite directions.

16. A current-compensated choke with a first current path and a second current path, wherein each current path comprises a first winding and a second winding that are connected in parallel and wound on a common core;

wherein each winding forms an individual layer around the core and each individual layer includes only one winding, wherein a wire from a first individual layer lies at least partially within an intermediate space between two wires of a second individual layer adjacent to the first individual layer;

wherein the individual layers lie on top of another in such a manner that the first winding of the first current path is followed by the first winding of the second current path, the first winding of the second current path is followed by the second winding of the first current path, and the second winding of the first current path is followed by the second winding of the second current path, wherein the windings are arranged in such a way that magnetic fields generated by the current paths at least for the most part compensate one another, wherein the windings belonging to each of the current paths have opposite winding directions, which allows cancellation of magnetic fields caused by current paths having the same direction; and wherein the first winding of the second current path has a greater distance from the core than the first winding of the first current path, the second winding of the first current path has a greater distance from the core than the first winding of the second current path, and the second winding of the second current path has a greater distance from the core than the second winding of the first current path.

* * * * *